United States Patent [19]

Tuominen et al.

[11] Patent Number: 4,865,663

[45] Date of Patent: Sep. 12, 1989

[54] HIGH TEMPERATURE SHAPE MEMORY ALLOYS

[75] Inventors: Steven M. Tuominen, Milford; Robert J. Biermann, Pinckney, both of Mich.

[73] Assignee: Armada Corporation, Detroit, Mich.

[21] Appl. No.: 170,165

[22] Filed: Mar. 18, 1988

Related U.S. Application Data

[63] Continuation-in-part of Ser. No. 28,208, Mar. 20, 1987, abandoned.

[51] Int. Cl.[4] ..... C22C 5/04; C22C 30/00

[52] U.S. Cl. ..... 148/402; 148/430; 420/463; 420/580

[58] Field of Search ..... 420/417, 463, 580; 148/402, 407, 421, 430

[56] References Cited

U.S. PATENT DOCUMENTS 4,728,580 3/1988 Grasselli et al. ..... 420/463

*Primary Examiner*—L. Dewayne Rutledge
*Assistant Examiner*—George Wyszomierski
*Attorney, Agent, or Firm*—Reising, Ethington, Barnard, Perry & Milton

[57] ABSTRACT

A nickel-titanium-palladium based alloy for converting heat energy into mechanical energy. The alloy exhibits shape memory. The alloy contains palladium to raise the temperature at which the alloy flexes between a deformed condition at a relatively colder temperature and a nondeformed condition at a relatively higher temperature. The alloy is characterized by including boron for increasing the fabricability of the alloy.

8 Claims, No Drawings

HIGH TEMPERATURE SHAPE MEMORY ALLOYS

RELATED APPLICATION

This is a continuation-in-part of Ser. No. 028,208 filed Mar. 20, 1987, now abandoned.

TECHNICAL FIELD

The present invention relates to nickel-titanium based alloys for converting heat energy into mechanical energy.

BACKGROUND ART

Nickel and titanium alloys are well known in the art. For example, U.S. Pat. No. 3,351,463 to Rozner et al issued Nov. 7, 1967 discloses nickel-titanium alloys. These alloys undergo temperature dependent transition from one solid phase to another solid phase. At a relatively colder temperature, the solid phase is the martensitic phase. Upon heating, the alloy passes through an intermediate rhombohedral phase. Finally, a high temperature body-centered cubic crystal is reached, referred to as austenite.

These nickel-titanium alloys exhibit shape memory, due to martensitic phase transformation. At a relatively colder temperature, below the transition temperature, the alloy can be placed in a deformed condition. Upon heating to a temperature greater than the transition temperature, the alloy returns to its original or neutral condition. The temperature range at which the alloy flexes between the deformed and the neutral conditions is known as the transition temperature range.

Known binary nickel and titanium alloys do not have a transition temperature range exceeding 250 degrees F. It is desirable to have a transition temperature range exceeding 300 degrees F to substantially increase the usefulness of the alloys. These alloys can then be used in systems having temperatures exceeding 300 degrees F.

By adding palladium to the nickel-titanium alloy, the transition temperature range can be increased to greater than 300 degrees F. Achievement of this high temperature transition range by adding palladium to a nickel-titanium alloy is disclosed in Kachin et al "High Temperature Shape Memory Effects in TiNi-TiPd System Alloys" translated from *Dokl, Akad. Nauk. SSSR,* Vol 257(1), 1981. The addition of palladium to the nickel-titanium alloy, however, reduces the fabricability, or ductility, of the alloy.

SUMMARY OF THE INVENTION

According to the present invention, there is provided an alloy composition which exhibits shape memory. The shape memory is due to thermoelastic martensitic phase transformation in response to heat by passing through a transition temperature between a relatively cool temperature below the transition temperature and a relatively warm temperature above the transition temperature. The composition consists essentially of from about 49.8 atomic % to about 50.7 atomic % titanium, from about 20.00 atomic % to about 35.00 atomic % palladium, from about 14.12 atomic % to about 29.19 atomic % nickel. The composition is characterized by including from about 0.04 atomic % to about 1.82 atomic % boron for increasing the fabricability thereof.

DESCRIPTION OF THE INVENTION

According to the present invention, there is provided an alloy composition consisting essentially of titanium, palladium, nickel, and characterized by including boron for increasing the fabricability of the alloy.

The fabricability is the ease with which the alloy can be processed into useful shapes, for example, into wire. It is defined in terms of elongation percentage. The elongation percentage is determined by using a standard tensile strength test which will be described subsequently. A greater elongation, i.e., the greater the wire stretches before breaking, results in easier fabricability or processing of the alloy into wire.

The alloy exhibits shape memory. This shape memory is due to thermoelastic martensitic transformation which occurs in response to heat being applied to the alloy. At a relatively cool temperature, below the transition temperature the alloy can easily be placed in a deformed condition. Upon heating the alloy to a temperature above the transition temperature, it returns to its original or neutral condition. The temperature range at which the alloy flexes between the deformed and neutral conditions is called the transition temperature range. It is also referred to as the martensitic transition temperature range.

One example illustrating the usefulness of such an alloy exhibiting shape memory properties is in a heat engine. In one type of heat engine wire, is initially at a relatively colder temperature below the transition temperature. A weight is added to deform the alloy. A second weight is then added. Heat is applied to the system, raising the temperature of the alloy above the transition temperature, causing the alloy to return to its original straight or neutral condition, raising the two weights. This results in useful mechanical energy. Such a process is disclosed in detail in U.S. Pat. No. 3,403,238 to Buchler et al issued Sept. 24, 1968. The system is subsequently cooled, and the process repeated.

ELEMENT PREPARATION

The titanium is prepared by obtaining titanium buttons weighing approximately 50 grams each. The titanium buttons are prepared from titanium granules. The granules preferably have an oxygen content of approximately 112 parts per million. Each titanium button is melted twice to insure complete melting. The titanium buttons are then preheated to 600 degrees Fahrenheit and rolled to thicknesses ranging from 0.087 to 0.010 inches. The rolled strips are cleaned using a wire brush before cutting into short segments approximately 0.3 to 1.0 inches long for alloy preparation.

The nickel used is preferably in the form of carbonyl pellets. Any form of nickel, however, having a low sulfur content can be used. The nickel should be prepared by etching the pellets in 50% HCl solution for 35 minutes to remove surface impurities. The nickel pellets are then rinsed four times with deionized water and subsequently in methanol.

The palladium to be used is preferably in the form of granules with a diameter of 0.20 inches or less.

The boron to be used is preferably in the form of a nickel-boron master alloy. Such a nickel-boron master alloy can be obtained from Shield Alloy Metallurg.

ALLOY PREPARATION

The alloys are preferably prepared in the form of buttons weighing between 50 and 80 grams. The buttons are melted in a vacuum-arc melting furnace containing four molds using a non-consumable tungsten electrode.

The vacuum chamber of the furnace is first evacuated and back-filled with an atmosphere of high-purity argon before melting of the alloy samples. Each button is then melted in a water-cooled copper mold. Each alloy button should be melted about six times. The solidified buttons are turned over after each melting to promote a uniform composition. Between each melting, the copper mold should be cleaned. The method of cleaning is to first brush and vacuum the mold cavities. Then the cavity is resealed with argon. Following the resealing a titanium button is melted to eliminate residual oxygen and atmospheric impurities. The alloys are then processed by extrusion into wire.

PROCESSING THE ALLOYS INTO WIRE

To extrude the alloys to wire, four segments of the alloys are placed in a steel block that is extruded. Four alloy segments are placed in symmetrically spaced holes drilled in the steel block. An end cap is welded over the open end of the holes to keep the alloy samples within the steel block. A coating of alumina powder is also applied to the samples to minimize mechanical bonding to the steel block during extrusion. The steel blocks are preheated to about 1600 degrees F. in a gas-fired furnace for one hour and extruded using a lubricant. The extrusion ratio used is preferably about 8.2 to 1 which indicates the alloy samples are elongated by a factor of about 8.2. The alloy samples are then removed from the steel bar by machining on a lathe. All remaining steel should be removed by grinding.

The extruded samples are then hot swaged. The alloy samples are preheated in a gas-fired furnace to approximately 1600 degrees F. but the actual swaging temperatures are significantly lower than 1600 degrees F. The alloys are then hot drawn using reductions of about one half gage pass per draw.

The alloys are then drawn at room temperature using diamond dies with an oil lubricant to provide strain hardening which is needed for a shape memory anneal. The alloy samples drawn into wire are then annealed at temperatures of 752 degrees Fahrenheit, 842 degrees Fahrenheit, 932 degrees Fahrenheit, 1022 degrees Fahrenheit, and 1112 degrees Fahrenheit for five minutes. The annealing should be done inside an alumina tube to keep the wires straight.

BEND TRANSITION TESTING

After annealing, each prepared wire was bent around a circular object of known radius. The wire samples were then heated by resting the samples in air in an enclosed glass chamber over a hot plate. The temperatures at which the wire first moved, and the range over which the fastest movement occurred were recorded for each sample tested. The temperatures at which movement ceased were also recorded. This method permitted controlled testing to temperatures over 700 degrees Farenheit. Testing at these high temperatures confirmed the original straight shape could be restored to each sample.

The bend transition temperature test results are indicated in Table 1. Table 1 lists the alloy compositions tested given in atomic percentage of each element. Further, Table 1 lists the transition temperature in degrees Fahrenheit for the different alloys and at different annealing temperatures. From the table it can be seen that the desired transition temperature range occurred with palladium levels of between about 22.30 atomic percent and about 35 atomic percent. It can also be seen that additions of up to 1 atomic percent boron had no significant influence on the transition temperature after annealing between the ranges of 752 to 1022 degrees F. The temperatures for rapid movement of the boron containing alloys were increased after annealing at 1112 degrees F. However, Alloy #14, having 1.82 atomic percent boron, showed no such increase in transition temperature.

TABLE 1

| Alloy # | Alloy Composition; Atomic Percent | | | |
|---|---|---|---|---|
| | Ti | Ni | Pd | B |
| 1 | 50.7 | 29.27 | 20.0 | 0.03 |
| 2 | 50.7 | 29.19 | 20.0 | 0.11 |
| 3 | 50.7 | 29.05 | 20.0 | 0.25 |
| 4 | 50.7 | 27.00 | 22.3 | 0.00 |
| 5 | 50.7 | 26.88 | 22.3 | 0.12 |
| 6 | 50.7 | 22.30 | 27.0 | 0.00 |
| 7 | 50.7 | 22.26 | 27.0 | 0.04 |
| 8 | 50.7 | 22.16 | 27.0 | 0.14 |
| 9 | 50.7 | 22.10 | 27.0 | 0.20 |
| 10 | 50.7 | 22.08 | 27.0 | 0.22 |
| 11 | 50.7 | 21.91 | 27.0 | 0.39 |
| 12 | 50.7 | 21.70 | 27.0 | 0.60 |
| 13 | 50.7 | 21.29 | 27.0 | 1.01 |
| 14 | 50.7 | 20.48 | 27.0 | 1.82 |
| 15 | 49.8 | 23.12 | 27.0 | 0.08 |
| 16 | 50.0 | 22.91 | 27.0 | 0.09 |
| 17 | 50.2 | 22.71 | 27.0 | 0.09 |
| 18 | 50.4 | 22.50 | 27.0 | 0.10 |
| 19 | 50.7 | 20.18 | 29.0 | 0.12 |
| 20 | 50.7 | 18.20 | 31.0 | 0.10 |
| 21 | 50.7 | 14.29 | 35.0 | 0.01 |
| 22 | 50.7 | 14.17 | 35.0 | 0.13 |
| 23 | 50.7 | 14.12 | 35.0 | 0.18 |

| Alloy # | Annealing Temp (°F.) | | | | |
|---|---|---|---|---|---|
| | 752 | 842 | 932 | 1022 | 1112 |
| | Transition Temperature Range (°F.)* | | | | |
| 1 | 162–325 | 180–351 | 195–290 | 215–300 | 187–264 |
| 2 | 145–332 | 364–393 | 192–290 | 188–296 | 172–258 |
| 3 | 225–293 | 231–297 | 230–280 | 233–276 | 266–296 |
| 4 | 210–276 | 250–272 | 256–275 | 274–290 | 260–296 |
| 5 | 215–318 | 217–294 | 230–308 | 255–308 | 265–308 |
| 6 | 301–420 | 278–448 | 320–410 | 333–442 | 332–390 |
| 7 | 290–360 | 283–340 | 311–344 | 335–363 | 358–400 |
| 8 | 349–424 | 345–400 | 349–394 | 359–388 | 382–407 |
| 9 | 203–435 | 255–415 | 298–375 | 355–430 | 390–455 |
| 10 | 335–410 | 315–392 | 320–380 | 322–374 | 345–388 |
| 11 | 251–415 | 222–415 | 342–373 | 371–422 | 340–473 |
| 12 | 340–388 | 304–383 | 315–375 | 317–354 | 350–385 |
| 13 | 346–373 | 333–387 | 336–388 | 336–361 | 365–396 |
| 14 | 179–448 | 278–466 | 246–410 | 288–456 | 296–420 |
| 15 | 332–385 | 324–360 | 360–370 | 391–421 | 391–421 |
| 16 | 302–405 | 318–360 | 320–350 | 349–383 | 366–396 |
| 17 | 340–420 | 344–415 | 360–410 | 388–408 | 396–421 |
| 18 | 343–420 | 352–390 | 354–377 | 404–430 | 411–425 |
| 19 | 271–451 | 312–440 | 400–456 | 390–455 | 406–473 |
| 20 | 286–495 | 307–497 | 407–471 | 432–480 | 424–505 |
| 21 | 490–585 | 508–638 | 555–600 | 536–635 | 560–612 |
| 22 | 518–612 | 595–700 | 330–602 | 345–612 | 366–570 |
| 23 | 537–595 | 577–610 | 542–600 | 576–623 | 596–637 |

*The first temperature given is that at which rapid movement of the wire from the deformed to the neutral condition began. The second temperature given is that at which all movement ceased. There was some slow shape recovery which occurred before the onset of rapid movement.

As indicated in Table 1, all of the samples exhibited the desired transition temperature of greater than 300° F. at at least one anneal temperature (except for alloy numbers 3 and 4 which transition temperatures approached 300° F.).

ELONGATION CHARACTERISTICS OF THE SAMPLES

The fabricability of each of the samples was tested. The fabricability was tested in terms of elongation percentage. The elongation percentage was obtained by performing a standard tensile test on each wire sample.

The ends of each wire sample were clamped. One end was pulled at a fixed rate and the amount of stretch before the breaking was recorded. The tested length of each wire was 2 inches. The results of the tensile tests can be found in Table 2.

As can be seen in table 2, boron additions effect the fabricability of the alloys. Generally, additions of boron increase the fabricability of the alloys. Five species of the alloys were tested (as represented by Table 1). These species were: (1) 50.7 atomic % titanium, 20.0 atomic % palladium, and varying nickel and boron; (2) 50.7 atomic % titanium, 22.3 atomic % palladium and varying nickel and boron; (3) 50.7 atomic % titanium, 27.0 atomic % palladium, and varying nickel and boron (in these first three alloy species, the nickel concentration varied as a result of boron additions); (4) between 49.8 and 50.4 atomic % titanium and 27.0 atomic % palladium with varying nickel and boron concentrations; and (5) 50.7 atomic % titanium and between 29,0 and 35.0 atomic % palladium with varying nickel and boron. As shown in Table 2, within each of the aforementioned groups there were alloys which showed an elongation greater than the alloys containing no boron.

TABLE 2

| Alloy # | Atomic % B | Elongation Percentage |
|---|---|---|
| 1 | 0.03 | 5.77 |
| 2 | 0.11 | 10.97 |
| 3 | 0.25 | 5.07 |
| 4 | 0.00 | 5.50 |
| 5 | 0.12 | 7.70 |
| 6 | 0.00 | 5.33 |
| 7 | 0.04 | 4.07 |
| 8 | 0.14 | 7.90 |
| 9 | 0.20 | 8.23 |
| 10 | 0.22 | 9.53 |
| 11 | 0.39 | 8.87 |
| 12 | 0.60 | 6.13 |
| 13 | 1.01 | 4.67 |
| 14 | 1.82 | 7.60 |
| 15 | 0.08 | 9.90 |
| 16 | 0.09 | 11.73 |
| 17 | 0.09 | 10.00 |
| 18 | 0.10 | 11.87 |
| 19 | 0.12 | 8.87 |
| 20 | 0.10 | 10.23 |
| 21 | 0.01 | 9.43 |
| 22 | 0.13 | 10.30 |
| 23 | 0.18 | 8.57 |

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An alloy composition which exhibits shape memory due to thermoelectric martensitic phase transformation in response to heat by passing through a transition temperature between a relatively cool temperature below said transition temperature and a relatively warm temperature above said transition temperature, said composition consisting essentially of from about 49.80 atomic % to about 50.40 atomic % titanium, about 27.0 atomic % palladium, from about 22.50 to about 23.12 atomic % nickel, said composition further including from about 0.08 atomic % to about 0.10 atomic % boron for increasing the fabricability thereof.

2. An alloy composition which exhibits shape memory due to thermoelastic martensitic phase transformation in response to heat by passing through a transition temperature between a relatively cool temperature below said transition temperature, and a relatively warm temperature above said transition temperature said composition consisting essentially of about 50.70 atomic % titanium, from about 29.0 to about 35.0 atomic % palladium, from about 14.12 atomic % to about 20.18 atomic % nickel, said composition further including from about 0.01 atomic % to about 0.18 atomic % boron for increasing the fabricability thereof.

3. The alloy composition as set forth in either claim 1 or 2 wherein said transition temperature is above 300° F.

4. An alloy composition which exhibits shape memory due to thermoelastic martensitic phase transformation in response to heat by passing through a transition temperature between a relatively cool temperature below said transition temperature and a relatively warm temperature above said transition temperature, said composition consisting essentially of about 50.7 atomic % titanium, about 27 atomic % palladium, from about 21.70 to about 22.16 atomic % nickel, said composition further including from about 0.14 atomic % to about 0.60 atomic % boron for increasing the fabricability thereof.

5. An alloy composition which exhibits shape memory due to thermoelastic martensitic phase transformation in response to heat by passing through a transition temperature between a relatively cool temperature below said transition temperature and relatively warm temperature above said transition temperature, said composition consisting essentially of 50.7 atomic % titanium, about 20.0 atomic % palladium, from about 29.19 atomic % to about 29.27 atomic % nickel, said composition further including from about 0.03 atomic % to about 0.11 atomic % boron for increasing the fabricability thereof.

6. An alloy composition which exhibits shape memory due to thermoelastic martensitic phase transformation in response to heat by passing through a transition temperature between a relatively cool temperature below said transition temperature and a relatively warm temperature above said transition temperature, said composition consisting essentially of about 50.7 atomic % titanium, about 22.3 atomic % palladium, about 26.88 atomic % nickel, said composition further including about 0.12 atomic % boron for increasing the fabricability thereof.

7. An alloy composition which exhibits shape memory due to thermoelastic martensitic phase transformation in response to heat by passing through a transition temperature between a relatively cool temperature below said transition temperature and a relatively warm temperature about said transition temperature, said composition consisting essentially of about 50.7 atomic % titanium, about 27.0 atomic % palladium, about 20.48 atomic % nickel, said composition further including about 1.82 atomic % boron for increasing the fabricability thereof.

8. The alloy composition as set forth in any one of claims 4, 6 or 7 wherein said transition temperature is above 200° F.

* * * * *